United States Patent [19]

Rupley

[11] 4,249,182

[45] Feb. 3, 1981

[54] QUICK-DETACHABLE ANTENNA MOUNT

[76] Inventor: Orrin J. Rupley, 11225 1st Ave., Hesperia, Calif. 92345

[21] Appl. No.: 970,250

[22] Filed: Dec. 18, 1978

[51] Int. Cl.[3] ..... H01Q 1/32

[52] U.S. Cl. ..... 343/715; 248/539

[58] Field of Search ..... 343/711, 713, 715, 720, 343/880, 881; 248/207, 226.1, 539, 226.2, 316 A, 316 B, 218.4

[56] References Cited

U.S. PATENT DOCUMENTS

| | | | |
|---|---|---|---|
| 722,828 | 3/1903 | Fergusson | 248/226.1 |
| 1,074,648 | 10/1913 | Schwartzberg | 248/316 B |
| 2,833,502 | 5/1958 | Wildeboor | 248/226.1 |
| 3,710,339 | 1/1973 | Rima | 343/715 |
| 3,967,275 | 6/1976 | Wagman | 343/715 |
| 4,003,540 | 1/1977 | Hawks | 248/226.1 |
| 4,161,735 | 7/1979 | Zylla | 343/713 |

*Primary Examiner*—Eli Lieberman

*Attorney, Agent, or Firm*—Poms, Smith, Lande & Rose

[57] ABSTRACT

An antenna mount is provided for attaching a radio antenna to the exterior of a vehicle in a manner that allows the mount to be quickly removed from the vehicle. The mount includes two clamps which fit over the support frame bars for an accessory mounted on the exterior of a vehicle, such as a rearview mirror or luggage rack. The first clamp includes a base plate to which a radio antenna mounts. Pivotally connected to one end of the base plate is a support bar grip which attaches one end of the base plate to one of the supporting bars. A locking arm prevents the support bar grip from rotating relative to the base plate once the antenna mount is attached to the supporting bar. The second clamp also includes a grip for engaging a second support bar. This support bar grip is slidably attached to the base plate and prevents the first clamp from becoming disengaged from the supporting bar to which it is attached. A spring couples this support bar grip to the first clamp. The spring provides the necessary tension to hold the antenna mount on the supporting bars. A handle attached to this grip allows it to be pulled away from the supporting bar to which it attaches, thereby enabling the antenna to be either rotated about or completely removed from the support bar to which the first clamp attaches.

7 Claims, 6 Drawing Figures

QUICK-DETACHABLE ANTENNA MOUNT

FIELD OF THE INVENTION

The present invention relates to radio antenna mounts which attach to the exterior of the vehicles.

BACKGROUND OF THE INVENTION

The decreasing size and cost of today's mobile radio equipment has resulted in such equipment being installed in many vehicles. The AM radio found in older vehicles is being supplanted by AM/FM radios, CB radios, and amateur radio equipment. The increased use of such radio equipment and vehicles has brought about several complementary needs. First, the manner in which the radios and their accompanying antennas are mounted in vehicles has encouraged their theft. Many devices exist which allow a radio to be quickly removed from the vehicle to avoid theft, but few devices exist which allow the antenna to be easily and quickly removed from the exterior of a vehicle by the owner. As a result, the antenna, which itself is often an expensive item, is frequently the part of the radio system which is stolen. Consequently, there is a great need for an antenna mount which will allow an antenna to be quickly disconnected from the exterior of the vehicle.

This need is especially acute in the trucking industry because the companies that own the vehicles typically do not furnish radio equipment to the drivers. Thus, the radio equipment in the truck is often the driver's personal property. As the radios in the truck are often a vital means of learning about traffic conditions and relaying emergency information, drivers have gone to great lengths to protect the radio antennas. Often, however, the devices which the drivers use to quickly attach the antennas to the outside of the trucks has resulted in damage to the trucks themselves. For example, truck drivers have attached their antennas to the mounting brackets of the external rearview mirrors of their vehicles with Vise-Grip type tools or similar self-locking tools. Also, drivers have taken to bolting and unbolting their antennas from the exterior of their trucks. As these methods are unsatisfactory both to the drivers and to the trucking companies, a device is needed which will allow an antenna to be quickly mounted and dismounted from the supporting bars of the external rearview mirrors found on many trucks. Additionally, such a device must resist the heavy vibration present in many vehicles, such as trucks, which tends to dislodge such devices.

The second need, is related to the first. The commercial vehicles owned by many companies and the personal and/or recreational vehicles owned by many families frequently have provisions for mounting radios in them. However, there are often more vehicles than there are radios; consequently, a single radio may be used in different vehicles at different times. As discussed above, devices which allow quick mounting and dismounting of radios within the vehicles themselves are available. However, devices which allow the quick mounting and dismounting of an antenna from the vehicles are not so easily found. This has resulted in antennas being permanently affixed to all of the vehicles in which a single radio could possibly be mounted. Having multiple antennas for a single radio is not only expensive, but encourages the theft situation discussed above. An antenna mount which could be quickly connected and disconnected from the exterior of the vehicle would not only reduce the number of antennas required for a given radio system, but would also help to discourage theft. Additionally, the installation of such systems on different types vehicles would be encouraged. That is, an antenna mount designed for mounting on the luggage rack of a family station wagon or sports car could also be attached to the external rearview mirror supporting bars of a recreational vehicle, the lifeline supporting bars on a sailboat, or on some corresponding exterior structure of a light airplane.

An additional problem which has presented itself more frequently in recent years is the low overhead clearance at the entrance of many parking structures and service garages. This low overhead clearance has often necessitated the removal of the antenna, or the use of an antenna which is less suitable than the one desired. Consequently, a need exists for an antenna mount which, in addition to providing the features discussed above, allows an antenna to be rotated from a vertical orientation with respect to the top of a vehicle to an orientation parallel with the top of a vehicle without causing the antenna to become disengaged from the vehicle itself.

Finally, some of the antenna mounts found in the prior art provide one or more of the above features, but are restricted in their application to specific types of vehicles or mounting situations. Thus, a need exists to provide an antenna mount which has the features discussed above and which is adaptable to be mounted in different positions on different types of structures supporting accessories on the exterior of a vehicle.

Accordingly, it is the principal object of this invention to allow a radio antenna to be quickly mounted and dismounted from a accessory supporting structure on the exterior of a vehicle.

It is another object of this invention to facilitate the mounting of radio antennas on the accessory supporting structures found on various types of vehicles.

It is a final object of this invention to allow an antenna mounted on the exterior of a vehicle to be rotated with respect to the vehicle, so as to allow the vehicle to enter parking structures and service garages without striking the antenna on the structures.

SUMMARY OF THE INVENTION

The present invention, in one illustrative embodiment, involves a radio antenna bracket which can be quickly mounted to and dismounted from at least two of the members supporting an accessory on the exterior of a vehicle, such as a rearview mirror or luggage rack. The antenna mount includes two clamps which fit over the support frame bars for such accessories. In the illustrated embodiment, the antenna mount is shown attached to the upper supporting bars of a rearview mirror.

The first clamp includes a base plate adapted to support a radio antenna on accessory supporting bars of differing sizes, shapes, and configurations. Pivotally connected to one end of this base plate is a pair of support bar grips which partially enclose each side, in opposing directions at spaced points, one of the supporting bars. The grips attach one end of the base plate to one of the supporting bars and allow the antenna mount to be assembled to or disassembled from the bar by rotating the spaced grips about a predetermined axis transverse to the axis of the bar. The support bar grips have attached to them a locking arm, whose function is to lock the grips to a fixed orientation, relative to the base plate, when the antenna mount is affixed to the supporting bar. The ability to lock the support bar grips in different orientations relative to the base plate allows the antenna mount to be affixed to supporting bars having different angular orientations. This feature is especially helpful as the supporting bars attaching rearview mirrors to the exterior of vehicles often vary in their configuration.

The second clamp restrains the first clamping means from rotating about the supporting bar to which it attaches. The second clamp also includes a support bar grip. This support bar grip partially encloses another one of the supporting bars and prevents the first clamp from disengaging the supporting bar to which it is attached. The support bar grip is slidably mounted on the base plate and is connected to the first clamp by a spring which biases the support bar grip toward the supporting bar which it partially encloses. This configuration provides the necessary tension to hold the antenna mount on the supporting bars. The configuration also prevents the heavy vibration present in some vehicles, such as trucks, from shaking the antenna mount loose from the supporting bars. Additionally, the support bar grip is provided with a handle which allows the support bar grip to be manually pulled away from its supporting bar. In this manner, the antenna mount may either be rotated about or completely removed from the supporting bar to which the first clamp attaches.

The tensioned support bar grip on the second clamp interacts with the locking arm on the first clamp to allow the antenna mount to be quickly mounted and dismounted from vehicle accessory supporting bars. The antenna mount is first mounted on the accessory supporting bars by adjusting the position of the support bar grip relative to the first clamp with the locking arm until the base plate is parallel to the side of the vehicle. Once this adjustment is made, the locking arm is set to lock the support bar grip in place. The handle means on the second clamp is then grasped and the support bar grip on the second clamp is pulled away from the first clamp until the support bar grip is able to be fitted over another of the supporting bars. As mentioned, the spring on the second clamp keeps the antenna mount attached to the supporting bars.

To disconnect the antenna mount, either the handle can be grasped to pull the support bar grip on the second clamp away from its supporting bar, or the locking arm on the first clamp can be released. In either case the antenna mount can then be easily removed from the accessory supporting bars. It is this quick-disengagement feature of the invention which not only allows the antenna to be removed from the vehicle so as to prevent theft, but which also allows a single antenna to be used with several different vehicles.

In accordance with one feature of the invention, the base plate portion of the first clamp includes a provision for maintaining the antenna in a vertical orientation as the first clamp is mounted in different orientations. This feature allows the antenna mount to be attached to the exterior of a vehicle with the base plate in a horizontal position, in addition to being attached to the upper supports of such a mirror as shown in the illustrated embodiment. The provision for maintaining the antenna in a vertical orientation adds great flexibility to the positions in which the antenna mount can be attached to a vehicle. This feature is most useful when the antenna mount is attached to supporting bars of accessories other than rearview mirrors, such as luggage racks. This feature is also useful in marine applications, which could typically involve such a mount being attached to the lifeline supports surrounding the edge of a sailboat.

In accordance with still another feature of the invention, the design of the first clamp allows the antenna to be rotated perpendicular to the axis of the bar engaged by the first clamp. This feature is most helpful when the second clamp is disengaged to lower the antenna as the vehicle enters a parking structure or service garage. When the antenna mount is in this portion, the weight of the antenna itself helps to prevent movement about the bar to which the first clamp is attached.

In accordance with still another feature of the invention, the base plate portion of the first clamp includes an insulator, to which the antenna is attached, which electrically isolates the electrical conductor within the antenna from the bracket. Additionally, most antennas are connected to radios by means of a coaxial wire, in which the center or signal conductor wire is surrounded by a braided conductor. This braided conductor shields the signal conductor from electrical interference and is typically attached to electrical ground at the radio. The electrical ground also attached to the vehicle frame, thereby making the vehicle the ground plane of the antenna. As the performance of the antenna is optimized when its mounting bracket is also tied to the ground plane, a lug is provided on the base plate to attach the shield conductor within the coaxial wire to the base plate. Thus, the coaxial wire attaches to the antenna mount by connecting the signal conductor directly to the antenna and the shield conductor to the base plate.

In accordance with a final feature of the invention, the design of the antenna mount allows it to be constructed of various materials such as steel, aluminum, or high-strength plastic.

Other features and advantages of the present invention will become apparent from a consideration of the following detailed description and from the accompanying drawings.

DETAILED DESCRIPTION

Figure 1:
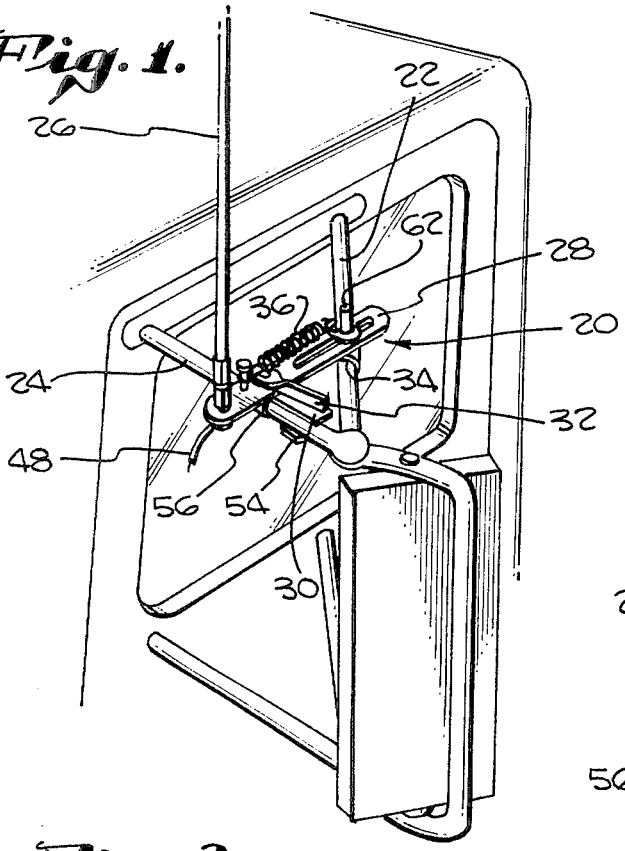
FIG. 1 is an isometric view of an antenna mount, constructed according to the present invention, installed on the upper supporting bars of a automobile or truck rearview mirror.
Figure 4:
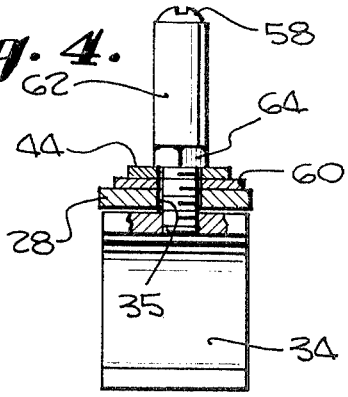
FIG. 4 is a detail view of the antenna mount of FIG. 3, taken along plane IV—IV, showing the support bar grip portion of the second clamp.

Referring more particularly to the drawings, FIG. 1 shows a quick-detachable antenna mount 20 installed on the front 24 and rear 22 supporting bars of an external rearview mirror of an automobile or truck. A radio antenna 26, which may be of the type used for AM/FM, CB, or amateur radio operation is attached vertically to the antenna mount 20.

Figure 5:
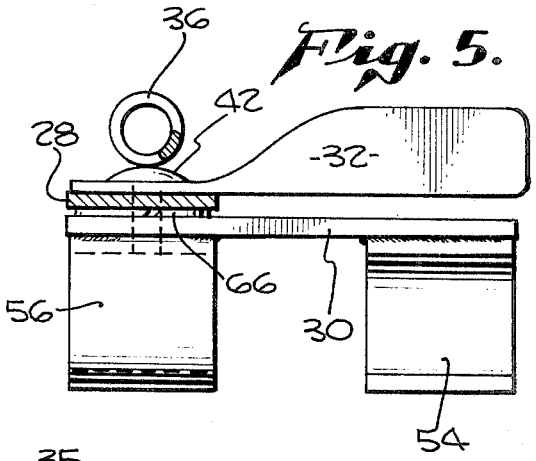
FIG. 5 is a detail view of the antenna mount of FIG. 3, taken along plane V—V, showing the locking arm and support bar grip portions of the first clamp.
Figure 2:
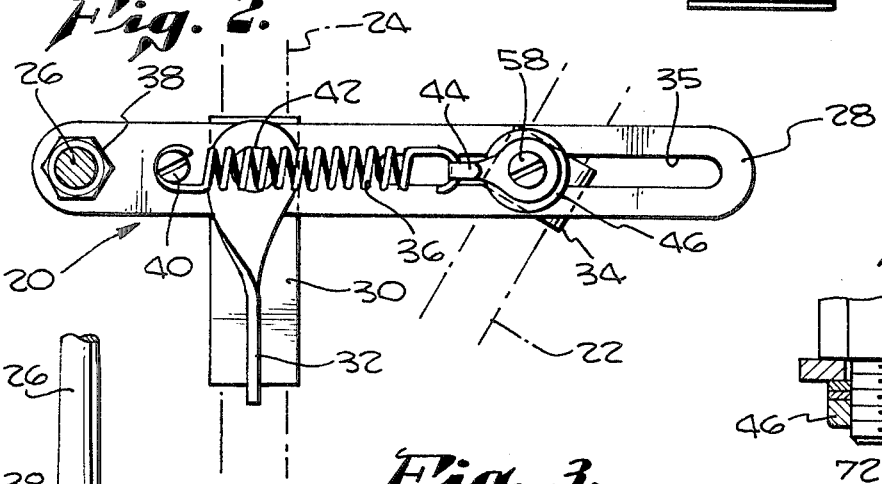
FIG. 2 is a top view of the antenna mount of FIG. 1, showing the positioning of the two clamps which attach the antenna mount to the two rearview mirror supporting bars.

As shown in more detail in FIG. 2, the antenna mount 20 incorporates around two clamps. The elements of the first clamp attach to a base plate 28. Pivotally connected toward one end of the base plate 28 are a pair of support bar grips 54 and 56, which partially enclose each side, in opposing directions at spaced points, the front supporting bar 24. The grips 54 and 56 are U-shaped and are attached to a supporting plate 30 (see FIG. 5). The support plate 30 pivotally connects to the base plate 28 by means of a carriage bolt 42. Between the bolt 42 and the upper side of the base plate is a locking arm 32. Between the base plate 28 and the grip support plate 30 is a lockwasher 66, which is shown in more detail in FIG. 6.

The upper portion of the bolt 42 has a square shape in cross section. The opening in the locking arm 32 through which the bolt 42 passes is also square. The lower portions of the bolt 42, which pass through the support plate 30, the lockwasher 60, the support plate 30, and one of the support bar grips 56, are threaded and are round in cross section. The end of the bolt 42 is rotatably connected to one of the support bar grips 56. This manner of interconnecting these components allows the supporting plate 30 to freely pivot, relative to the base plate 28, when the locking arm 32 is rotated away from the antenna 26. As the locking arm 32 is rotated toward the antenna 26, the bolt 42 is rotated by the locking arm 32 in a clockwise direction. This rotation of the bolt 42 draws the suppport plate 30 closer to the base plate 28, thereby compressing the lockwasher 66. The compression increases, as the locking arm 32 is rotated, until it prevents any further rotation of the arm 32. At this point, the support plate 30 is "locked" in a fixed position relative to the base plate 28. The support plate 30 is "released" by rotating the locking arm 32 away from the antenna 26.

As discussed, the function of the locking arm 32 is to lock the grip support plate 30 in a fixed orientation relative to the base plate 28 in order that the antenna mount may be fitted to supporting bars of different orientations. In the preferred orientation, shown in FIG. 1, the base plate is positioned parallel to the body of the vehicle. To achieve this orientation, the antenna mount 20 is first positioned such that the support bar grips 54 and 56 are transverse to the axis of the supporting bar to which they will attach. The antenna mount 20 is then rotated until the support bar grips 54 and 56 come in contact with opposite sides of the support bar. The antenna mount 20 is then moved until the base plate 28 is parallel with the vehicle body. At this point, the locking arm 32 is moved toward the antenna 26. As described above, this action tends to compress the lockwasher 66, thereby making it resist any further movement of the grip support plate 30 relative to the base plate 28.

The other portion of the antenna mount 20 is the other clamp which attaches to another of the mirror supporting bars. The second clamp prevents the first clamp from becoming disengaged from the supporting bar to which it attaches. As shown in detail in FIGS. 2 and 3, the second clamp includes a support bar grip 34 which slidably moves along a cutout 35 in the base plate 28. The support bar grip 34 also is U-shaped and is attached to the base plate 28 by a screw 58, a nut 64, and a washer 60. The support bar grip 34 is biased toward the other grips 54 and 56 by a spring 36 attached between a screw 40 in the base plate and a hook 44 attached to a screw 58 passing into the support bar grip 34. A plurality of nuts 52 hold the base plate screw 40 to the base plate 28. The spring arrangement provides the necessary tension to hold the antenna mount on the two supporting bars 22 and 24. This particular arrangement also resists the heavy vibration present in many vehicles, such as trucks, which tends to dislodge antenna mounts of other designs. Around the screw 58 passing into the support bar grip 34 is found a handle 62. This handle 62 facilitates the rapid mounting and dismounting of the antenna from the supporting bars.

Installation of the antenna mount 20 on the supporting bars 22 and 24 is done as follows. The first clamp is installed on its support bar 24 as described above. The second clamp is then installed on its supporting bar 22 by pulling the handle 62 away from the supporting bar 22. This allows the support bar grip 34 to be positioned around its supporting bar 22. When the handle 62 is released, the support bar grip 34 will contact its supporting bar 22 and will prevent the first clamp from disengaging the support bar 24 to which it is attached.

It is this tensioned support bar grip 34 which enables the antenna mount 20 to be quickly assembled to or disassembled from the supporting bars 22 and 24. The disassembly procedure is the opposite of the assembly procedure described above. Also, when the vehicle to which the antenna mount 20 is attached is entering a parking structure or service garage, the second clamp may be released from its supporting bar 22. This will allow the antenna mount 20 to rotate about the supporting bar 24 to which the first clamp attaches. In this manner, the antenna can be temporarily rotated to an orientation which is horizontal with respect to the vehicle, and thereby avoid damaging the antenna 26 on the structures.

Additionally, the arrangement of the clamps on the antenna mount 20 allows the antenna mount to be installed on supporting bars of other external vehicle accessories besides rearview mirrors. For example, the arrangement of the supporting bar grips 54, 56 and 34 allow the antenna mount 20 to be installed on the frame of a luggage rack or on the lifeline supports surrounding the edge of a sailboat. The quick-disengagement feature of the antenna mount 20, therefore, not only allows the antenna to be quickly removed from a vehicle to prevent theft, but also allows a single antenna to be used with several different vehicles.

Figure 6:
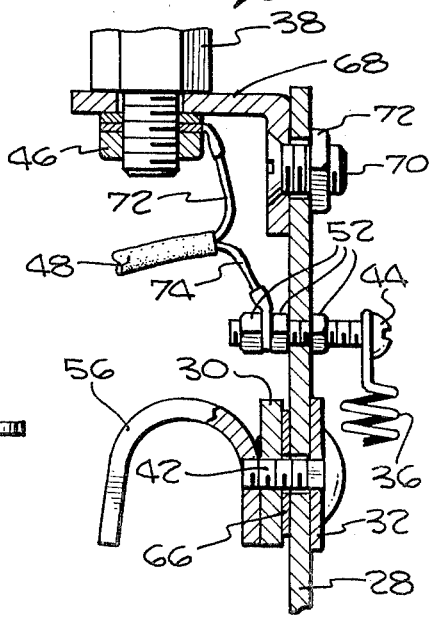
FIG. 6 shows an alternative embodiment of the antenna mount of FIG. 1, showing the modification made to the mount to maintain the antenna in a vertical orientation when the base plate portion of the antenna mount is not in a horizontal position.

As shown in FIG. 6, the antenna mount 20 may be equipped with a bracket 68 to position the antenna 26 in a vertical orientation when the antenna mount 20 is positioned in an orientation parallel to, rather than perpendicular with, the antenna 26. In this regard, the antenna bracket 68 is a L-shaped member which attaches to the base plate by means of a screw 70 and a nut 72. This bracket 68 allows base plate 28 to be oriented in other positions besides that depicted in FIG. 1. This provision for positioning the antenna mount 20 parallel to the antenna 26 itself lends much flexibility to the installation of such an antenna mount on external vehicle accessories other than rearview mirrors.

Figure 3:
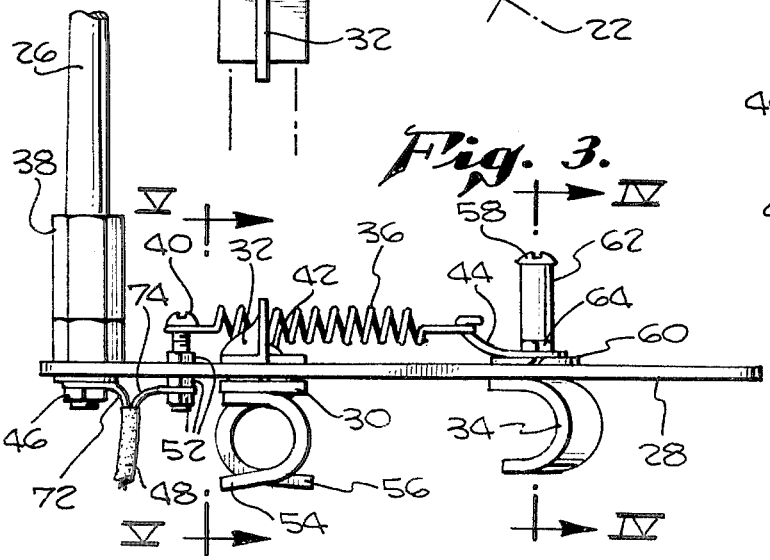
FIG. 3 is a side view of the antenna mount of FIG. 1.

As shown in detail in FIGS. 3 and 6, the antenna 26 attaches to the base plate 28 by means of an insulator 38. The insulator 38 electrically isolates the conductor within the antenna from the base plate 28. As also shown in FIGS. 3 and 6, a coaxial wire 48 provides the connection from the radio to the antenna 26. This coaxial wire 48 contains a signal conductor 72 and a braided shield conductor 74, which surrounds the signal conductor 72. The shield conductor 74 shields the signal conductor 72 from electrical interference and is connected to electrical ground at the radio, which is not separately shown in the Figures. The electrical ground at the radio also connects to the vehicle frame, thereby making the vehicle frame the ground plane of the antenna 26. As the performance of the antenna 26 is optimized when the antenna mount 20 is also attached to the ground plane, a provision exists for making such a connection. The screw 40, to which the spring 36 is attached, passes completely through the base plate 28. The shield conductor 74 from the coax 48 connects to this screw 40 by means of a nut 52. In this manner, the antenna mount 20 is connected to the vehicle ground plane. The signal conductor 72 attaches to the conductor in the antenna by means of a nut 46 on the base of the antenna 26. In this manner, proper electrical connection is made between the radio and the antenna.

Although other dimensions could of course be employed, the grips have a curvature to engage the normal $\frac{3}{4}$ inch diameter support bars found on trucks; the overall length of the plate 28 is about eight inches; and it is made of $\frac{1}{8}$ inch thick steel. The plate 30 is also made of $\frac{1}{8}$ inch thick steel and is about 3 inches long.

In the preferred embodiment, the antenna mount 20 is constructed or steel. Alternatively, other materials could be used, such as aluminum or high-strength plastic. If insulating plastic is used to construct the mount 20, conductive coatings or leads would be employed to provide a grounding connection for the coax shield conductor 74 to the support bars 22 and 24, and thus to the vehicle body.

In the foregoing description of the present invention, a preferred embodiment of the invention has been disclosed. It is to be understood that other mechanical and design variations are within the scope of the present invention. Thus, by way of example and not of limitation, the antenna could be positioned differently on the base plate; means other than a spring could be used to provide the necessary tension to hold the antenna mount on the supporting bar; a compression spring could be employed with the grips reversed; the support bar grips could be shaped differently than described; and means other than a locking arm could be used to affix the position of the first clamp relative to the base plate. Accordingly, the invention is not limited to the particular arrangement which has been illustrated and described in detail.

What is claimed is:

1. A manually, quickly-detachable and safely tiltable radio antenna mount for vehicles comprising:

first clamping means for fitting over a first support frame bar for an accessory mounted on the exterior of the vehicle, such as a rear view mirror or luggage rack, said first clamping means including two means for enclosing said bar in opposite directions at spaced points along said bar, said two enclosing means being spaced apart along the length of said frame bar, by a distance slightly greater than the thickness of the frame bar; whereby said clamping means can be assembled to or disassembled from said bar by rotating said spaced clamping means about a predetermined axis transverse to the axis of said bar;

second clamping means, resiliently coupled to said first clamping means, for engaging a second support frame bar and for restraining said first clamping means against rotation about said predetermined axis;

said first clamping means further including means for mounting said second clamping means at any desired orientation relative to said first clamping means while both of said enclosing means are engaging said first support bar;

means for securely fixing the selected angular orientation of said second clamping means relative to said first clamping means, whereby said mount may be securely fixed to said support bars whether said support bars are parallel to or are angled toward one another; and means for mounting a radio antenna on said first clamping means;

whereby said second clamping means may be manually resiliently released and said antenna tilted with said two engaging means safely retaining said antenna, and whereby said first clamping means may be manually rotated to quickly detach said antenna from the frame bars to safely store the antenna within the vehicle during short stops.

2. The detachable antenna mount defined in claim 1, further comprising means for maintaining a vertical orientation of said antenna as said clamp means are mounted in different orientations.

3. The detachable antenna mount defined in claim 1, wherein said first clamping means includes:

insulating means for electrically isolating the electrical conductor within said antenna from said antenna mount; and grounding lug means for electrically connecting the ground plane of said antenna to said antenna mount.

4. The detachable antenna mount defined in claim 1, wherein:

said means for mounting said second clamping means includes a base plate adapted to support said antenna on said supporting bars of differing sizes, shapes, and configurations;

said two means for enclosing includes support bar gripping means, pivotally connected to one end of said base plate and including means for partially enclosing each side, in opposing directions at spaced points, of one of said supporting bars, for attaching one end of said base plate to one of said supporting bars; and said means for securely fixing includes locking arm means, attached to said gripping means, for locking said gripping means to a fixed orientation, relative to said base plate, when said antenna mount is mounted to said supporting bars.

5. The detachable antenna mount defined in claim 1, wherein said second clamping means comprises:

supporting bar gripping means, partially enclosing another of said supporting bars and slidably mounted on said first clamping means, for preventing said first clamping means from disengaging the supporting bar to which said first clamping means is attached;

tensioning means, attached between said first clamping means and said second clamping means, for biasing said second clamping means toward the supporting bar which it partially encloses, thereby providing the necessary tension to hold said antenna mount on said supporting bars; and handle means, attached to said gripping means for manually pulling said gripping means away from the supporting bar which said gripping means encloses, thereby allowing said antenna mount to be either rotated about or completely removed from the supporting bar to which said first clamping means is attached.

6. The detachable antenna mount defined in claim 1, wherein said antenna mount includes means for mounting said antenna perpendicular to the axis of the bar engaged by said first clamping means, whereby when said second clamping means is disengaged and said antenna is lowered by tilting said antenna about the axis of said first bar, the movement about said predetermined axis is inhibited.

7. The detachable antenna mount defined in claim 1, wherein said means for securely fixing comprises:

locking means, attached to said means for enclosing said bar, for releasably determining an angular orientation between said enclosing means and said first support bar, said antenna mount thereupon being assembled to or disassembled from said first support bar by manually pulling said second clamping means to release said second clamping means from said second support bar, thereby allowing said assembly or disassembly of said first clamping means relative to said first support bar by said rotation about said predetermined axis.

* * * * *